US005505431A

United States Patent [19]

Vitale

[11] Patent Number: 5,505,431

[45] Date of Patent: Apr. 9, 1996

[54] FORCIBLE ENTRY TOOL

[75] Inventor: Martin H. Vitale, Osceola, Iowa

[73] Assignee: Iowa-American Firefighting Equipment Co., Osceola, Iowa

[21] Appl. No.: 142,063

[22] Filed: Oct. 28, 1993

[51] Int. Cl.[6] ..... B66F 3/24

[52] U.S. Cl. ..... 254/93 R

[58] Field of Search ..... 92/165 PR; 254/93 R, 254/93 H, 104, 133; 72/705; 29/239, 252, 275

[56] References Cited

U.S. PATENT DOCUMENTS 3,081,066 3/1963 Murawski ..... 254/93 R

*Primary Examiner*—Robert C. Watson

*Attorney, Agent, or Firm*—Kent A. Herink; Davis, Brown, Koehn, Shors & Roberts

[57] ABSTRACT

A forcible entry apparatus for use in obtaining access through an access blocking article. The apparatus is self-contained and provided with an anti-rotation assembly which prevents a movable foot from rotating in relationship to a stationary foot. The anti-rotation assembly thereby prevents the tool from becoming dislodged from an access blocking article during operation.

7 Claims, 5 Drawing Sheets

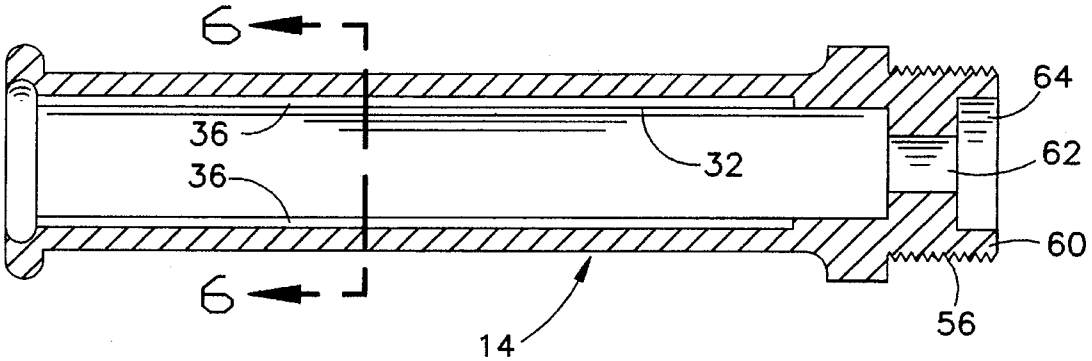
FIG. 5
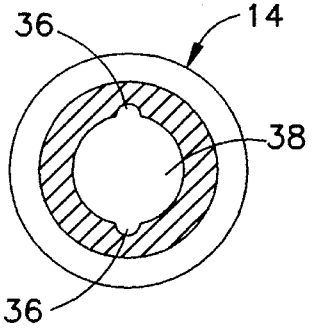
FIG. 6
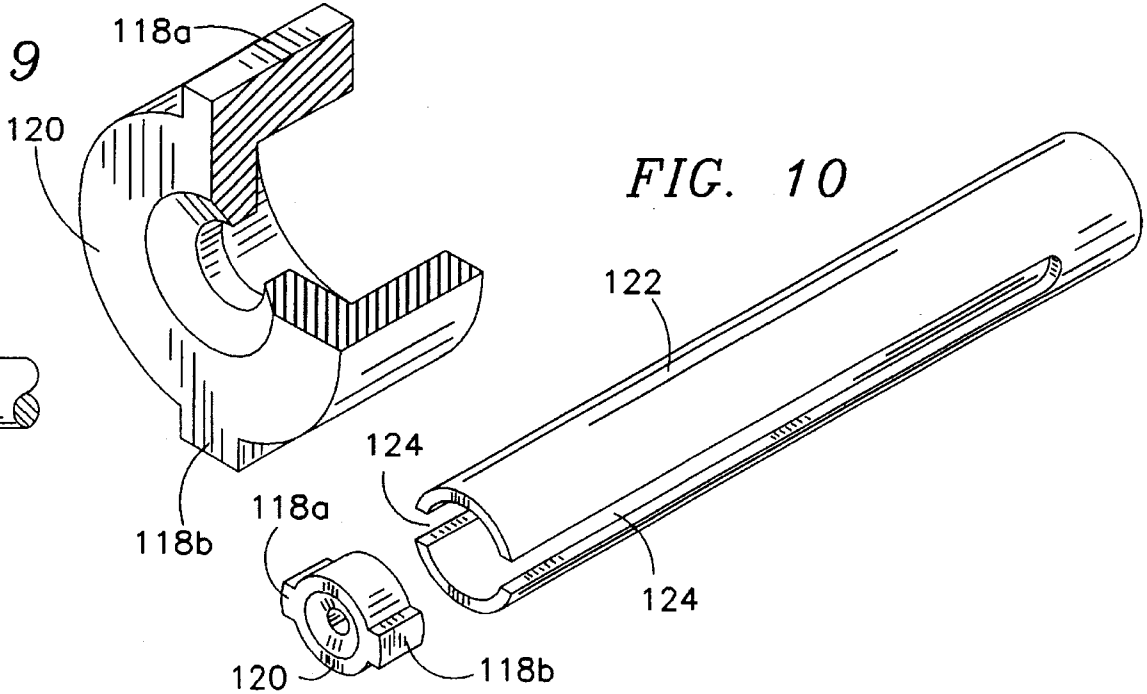
FIG. 10
FIG. 9
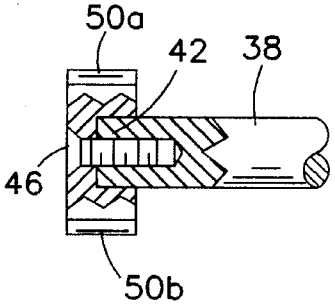
FIG. 7
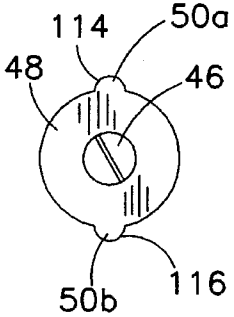
FIG. 8

FORCIBLE ENTRY TOOL

BACKGROUND OF THE INVENTION

The present invention relates generally to a one-piece forcible entry tool and, more particularly, to a one-piece forcible entry tool with a novel anti-rotation device which prevents the tool from rotating and dislodging from a door jamb or similar access blocking article during operation.

Portable forcible entry tools are well-known in the art and consist generally of a pair of feet, with one foot extensible in relationship to the other. Such tools are often used by law enforcement officials and fire department personnel to open doors or enter areas protected by locks. The tools may lave a separate pump or, alternatively, a pair of handles, one being stationary, with the other being movable in relationship to the stationary handle. The movable handle is connected to a hydraulic system which pumps hydraulic fluid into a hydraulic cylinder. The cylinder operates around a slide or similar structure connected to one of the feet. The foot which is not connected to the slide is connected to a frame, which houses the hydraulic cylinder.

Operation of the tool involves moving the feet into a closed position and forcing the feet between a door jamb and a door. The tool is inserted either manually, or by striking the strike plate with a hammer or other similar tool. The movable handle is then used to pump hydraulic fluid into the cylinder. As hydraulic fluid moves into the cylinder, it pushes the slide outward, thereby moving the moveable foot away from the stationary foot. As the two feet move apart, the door moves away from the jamb until the lock or other means maintaining the door closed is broken, or the door is open far enough to obtain access.

A typical problem associated with prior art forcible entry tools, is the tendency of the slide to rotate in relationship to the hydraulic cylinder as the feet press against the door jamb. The torque generated between the feet decreases the stability of the tool and may jar the tool loose from the door jamb before the door has been opened. In situations such as a burning building, where time is critical, crucial seconds used to move the feet of the tool back together and reinsert the tool between the door jamb and the door jamb could mean the difference between life and death.

To overcome the problem of the movable foot rotating in relationship to the stationary foot, guide bars are often employed which run parallel to the slide and are connected both to the frame and the movable foot. The addition of such guide bars rod not only increases the weight and bulk of the tool, but also decreases the ease with which the tool may be manipulated, thereby limiting the areas into which the tool can be placed. Furthermore, although such guide bar configurations add stability to the tool when the feet are relatively close together, the anti-rotation effect of the guide bars is significantly diminished as the feet are moved further away from one another. As the feet move farther apart, the torque on the feet begins to overcome the stabilizing effect of the guide bars.

Additional problems with prior art forcible entry tools are the intractability of the hoses used to transfer hydraulic fluid from the pumping mechanism to the extension mechanism and the additional weight added by external hoses and external pumps. The hoses increase the bulk of the tool, while exposing relatively delicate hydraulic lines to the possibility of snagging and puncture. The added weight and bulk of external bases and large anti-rotation makes carrying these tools difficult.

The difficulties encountered in the prior art discussed hereinabove are substantially eliminated by the present invention.

SUMMARY OF THE INVENTION

Accordingly, it is an object of the present invention to provide a forcible entry tool with an anti-rotation mechanism which does not significantly increase the bulk of the tool, A further object of the present invention is to provide a light weight forcible entry tool with an anti-rotation device, Another object of the present invention is to provide a forcible entry tool which does not expose hydraulic lines to exterior hazards, Still another object of the present invention is to provide a forcible entry tool with an anti-rotation device which does not diminish significantly in effectiveness as the device is extended.

These and other objects of the invention will become apparent upon reference to the following specification, drawings, and claims.

By the present invention, it is proposed to overcome the difficulties encountered heretofore. To this end, an extensible forcible entry tool is provided for gaining access to an area. The tool has both a first foot and a second foot. The feet are capable of being placed between a first access blocking article and a second access blocking article. The tool is equipped with means for moving the first foot away from the second foot with sufficient force to move the first access blocking article away from the second access blocking article. The tool has a frame operably connected to the second foot, wherein the frame is provided with a keyway. A slide is provided and is operably connected to the first foot. The slide is operably coupled to the frame for slidable movement in relationship thereto. A key is also provided and operably connected to the slide. The key is positioned within the keyway of the frame to prevent the slide from rotating with respect to the frame.

BRIEF DESCRIPTION OF THE DRAWINGS

In the drawings:

FIG. 5 is a cross-sectional view showing the keyways of the stationary handle;

FIG. 6 is a cross-sectional view of the stationary handle taken along line 5—5;

FIG. 7 is a side elevational view in partial cross-section showing the connection of the key nut to the slide;

FIG. 8 is a rear view of the key nut of the present invention;

FIG. 9 is an enlarged perspective view in partial cross-section of all alternative embodiment of the key nut of the present invention;

FIG. 10 is a perspective view of the key nut and a slide of the alternative embodiment of the present invention.

DETAILED DESCRIPTION OF THE PRESENT INVENTION

Figure 1:
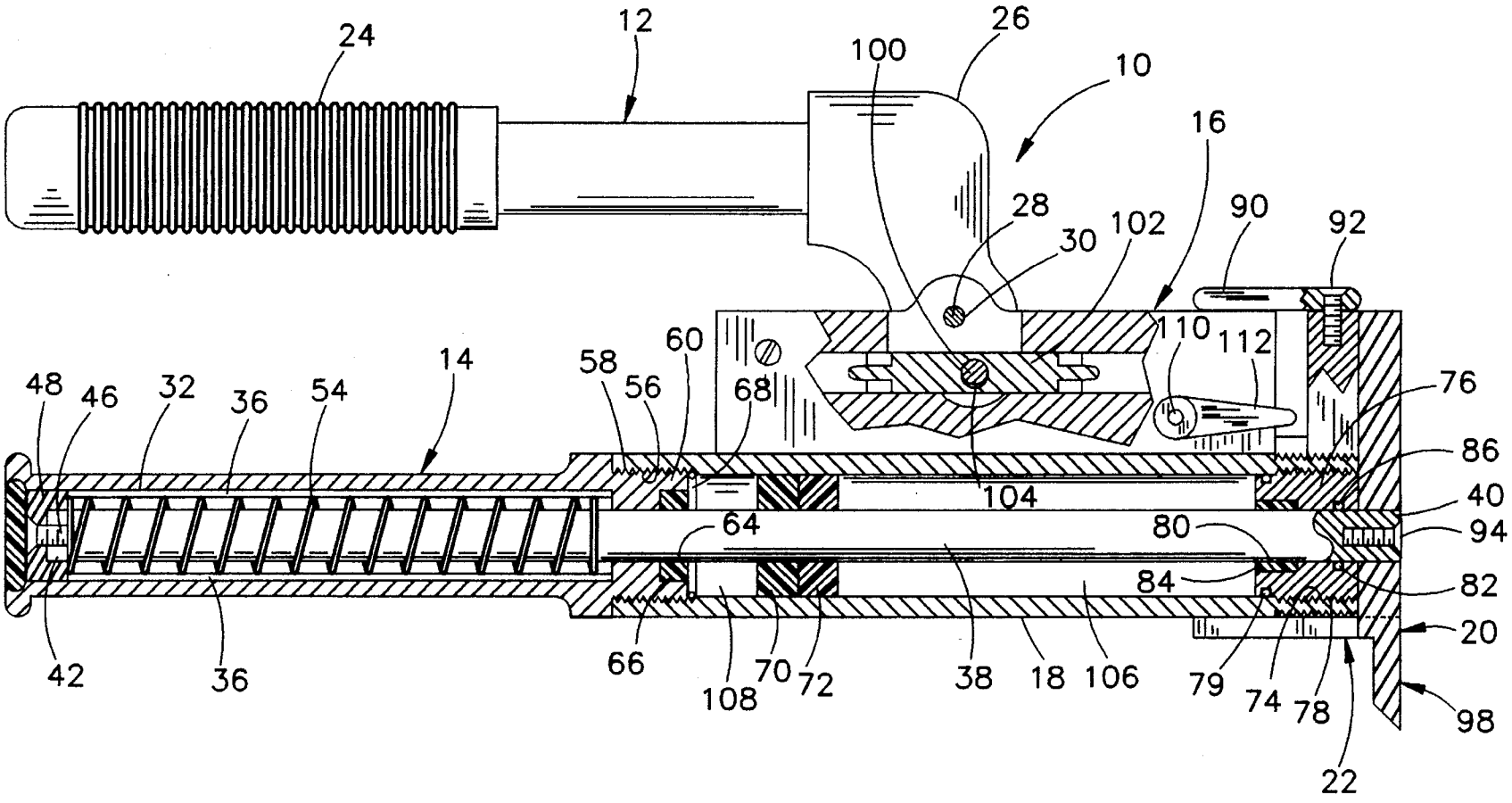
FIG. 1 is a side elevational view in partial cross-section of the present invention in the retracted position.

The present invention is a forcible entry tool 10 having a movable handle 12, a stationary handle 14, a pumping apparatus 16, a body 18, a movable foot 20 and a stationary foot 22. The tool 10 is operated by forcing the feet 20 and 22 into an area where access is desired such as between a locked door and a door jamb. The movable handle 12 is pumped back and forth in relationship to the stationary handle 14, causing the movable foot 20 to move away from the stationary foot 22. The door is thereby moved away from the door jamb. The pumping action continues until access can be obtained between the door and the door jamb.

In the figures, the handles 12 and 14 are preferably constructed of tubular aluminum to decrease the weight of the tool 10 (FIG. 1). The handles 12 and 14 may instead be constructed of high strength stainless steel if more strength is desired. The movable handle 12 is provided with a plastic or aluminum grip 24 to prevent a user's hand from becoming dislodged from the handle 12 during operation of the tool 10. The movable handle 12 is secured to a knuckle 26. The knuckle 26 is provided with a throughbore 28 through which passes a pin 30. The pin 30 is secured to the pumping apparatus 16 which allows the knuckle 26 to pivot in relationship to the pumping apparatus 16.

Figure 2:
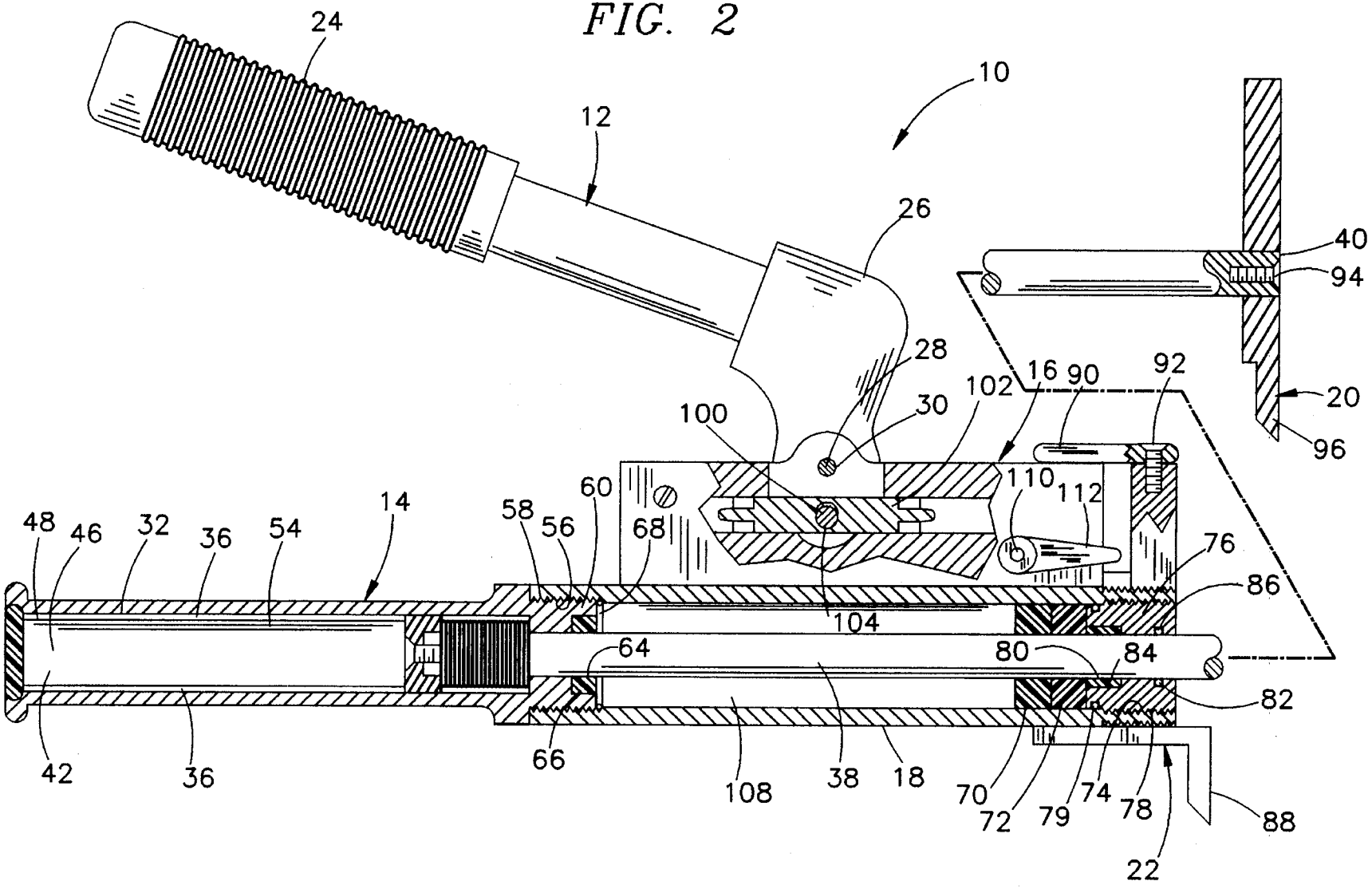
FIG. 2 is a side elevational view in partial cross-section showing the present invention in the extended position.
Figure 3:
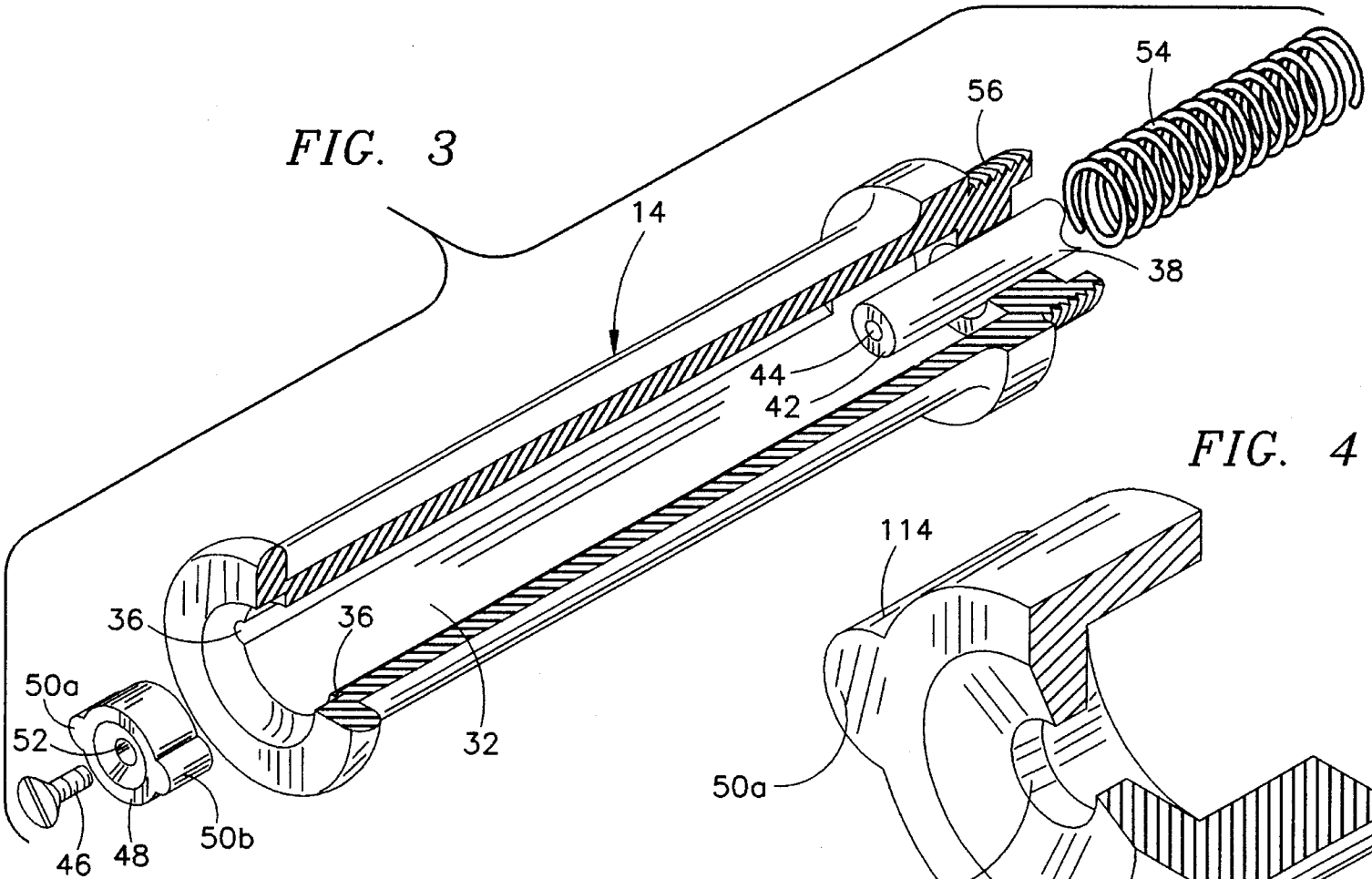
FIG. 3 is an exploded view in partial cross-section of the apparatus showing the key and keyway connection of the present invention.

An interior wall 32 of the stationary handle 14 is tooled to create a pair of keyways 36 (FIGS. 3 and 5). The keyways 36 are a pair of parallel slots running from one end of the handle 14 to within about one inch of the opposite side of the handle 14. One end of a slide 38 is positioned coaxially within the handle 14 (FIGS. 3 and 6). The slide 38 is a three-quarter inch steel rod, having an exposed end 40 secured to the movable foot 20 and a concealed end 42 positioned within the handle 14 (FIG. 2). The concealed end 42 of the slide 38 is provided with a threaded hole 44 for insertion of a screw 46 or a similar securement means (FIGS. 2 and 3). The slide 38 is positioned within the handle 14 (FIG. 6) and a key nut 48 is placed over the concealed end 42 of the slide 38 (FIGS. 7 and 8).

Figure 4:
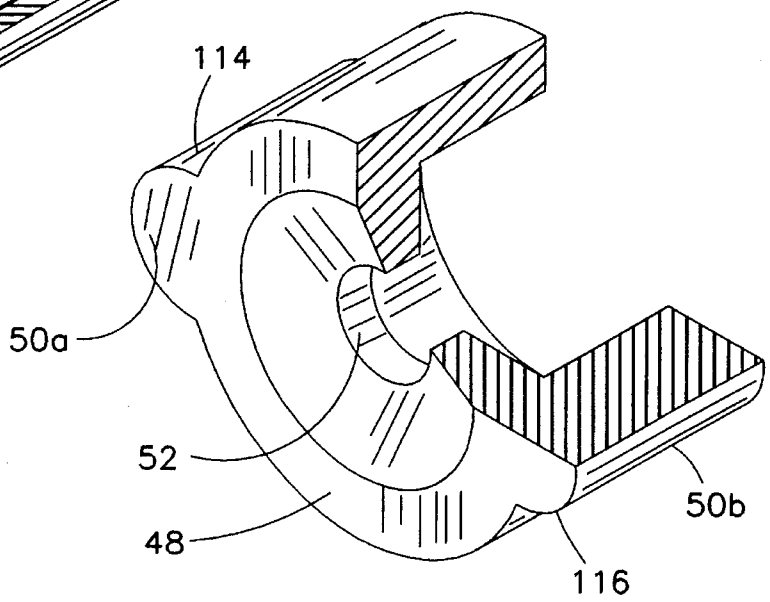
FIG. 4 is an enlarged perspective view in partial cross section showing the key nut of the present invention.

As shown in FIG. 4, the key nut 48 is a circular cap having a pair of keys 50*a–b* provided on its circumference. The key nut 48 is preferably constructed of steel to provide added strength and durability. The key nut 48 is provided with a hole 52 passing through the top of the key nut 48 to allow the screw 46 to pass through the key nut 48 (FIGS. 3, 7 and 8). The key nut 48 is fitted into the handle 14 so that the keys 50*a–b* of the key nut 48 fit within the keyways 36 of the handle 14. The key nut 48 is thereby capable of sliding in relationship to the handle 14. The keys 50*a–b* of the key nut 48, however, prevent the key nut 48 from rotating in relationship to the handle 14 and from passing out of the handle 14.

The key nut 48 is positioned within the handle 14 and over the end of the slide 38 (FIGS. 3 and 7). The screw 46 is inserted through the hole 52 in the key nut 48 and into the threaded hole 44 of the slide 38. The screw 46 is then screwed tightly into the slide 38 to prevent rotational movement of the key nut 48 relative to the slide 38 (FIGS. 7 and 8). Because the slide 38 is secured to the key nut 48, the slide 38 is prevented from rotating with respect to the stationary handle 14 (FIG. 3).

It is the action of the keys 50*a–b* against the keyways 36 of the handle 14 which provides the anti-rotation attribute to the tool 10 (FIG. 3). The keyways 50*a–b* prevent the sliding key nut 48 from rotating with respect to the handle 14 and stationary foot 22 (FIGS. 2 and 3). Since the movable foot 20 is operably secured to the slide 38 along with the key nut 48, the movable foot 20 is also prevented from rotating with respect to the handle 14 and the stationary foot 22.

Because the distance between the key nut 48 and the movable foot 20 is fixed, the anti-rotation property of the tool 10 is substantially independent of the distance between the stationary foot 22 and the movable foot 20 (FIGS. 2 and 3). Prior art devices use guide bars, which reduce rotation less effectively as the feet move further apart from one another. The present invention, however, maintains a constant anti-rotation attribute, substantially independent of the distance between the stationary foot 22 and the movable foot 20.

The key nut 48 and keyways 36 are fully contained within the interior of the tool 10, so the anti-rotation attribute of the tool 10 does not add extra bulk to the tool 10 (FIG. 2). Additionally, the key nut 48 and keyways 36 are lighter than prior art guide bar anti-rotation assemblies, making the tool 10 lighter than prior art tools.

Provided coaxially between the handle 14 and the slide 38 is a compression spring 54 (FIG. 1). The spring 54 is located between the key nut 48 and a forward end 60 of the stationary handle 14. The spring 54 is of a sufficiently large diameter to allow the spring 54 to freely compress and extend along the slide 38 as the key nut 48 contacts the spring 54 and moves back and forth along the keyways 36 of the handle 14.

The stationary handle 14 is preferably provided with male threads 56 mated to female threads 58 provided on the body 18 of the tool 10 (FIG. 1 and 5). The forward end 60 of the stationary handle 14 is provided with a hole 62 of a diameter slightly greater than the slide 38 and with a circular recess 64 of a diameter greater than the slide 38. Positioned within the recess 64 is a rear circular seal 66 of rubber or similar material having an outer diameter equal to the diameter of the recess 64. The inner diameter of the seal 66 is substantially equal to the diameter of the slide 38. An O-ring 68 is secured between the stationary handle 14 and the body 18 to prevent fluid from leaking out of the body 18.

Secured to the slide 38 at approximately its mid-point is a forward circular seal 70 having an outer diameter substantially equal to the inner diameter of the body 18 of the tool 10, and an inner diameter substantially equal to that of the slide 38 (FIG. 1). Secured to the slide 38, just behind the seal 70 is a seal backing 72 with dimensions similar to that of the seal 70. The seal backing 72 is secured to the slide 38 to allow hydraulic fluid within the body 18 to move the slide 38 by pressing against the seal 70 and seal backing 72.

The body 18 is preferably provided with a partially threaded interior 74, so that a front seal nut 76 with a threaded exterior 78 may be screwed into the body 18 (FIGS. 1 and 2). Provided between the front seal nut 76 and the body 18 is an O-ring 79 which prevents escape of fluid from the body 18. The front seal nut 76 is preferably provided with two recesses, a seal recess 80 and a wiper recess 82. Provided within the seal recess 80 is a seal 84 having an outer diameter substantially equal to that of the seal recess 80 and an inner hole with a diameter subsequently equal to that of the slide 38. A wiper 86, of similar dimensions, in relationship to the wiper recess 82, is provided within the wiper recess 82. The seal 84 and wiper 86 are preferably made of rubber or similarly resilient material resistant to degradization by hydraulic fluid.

Secured to the exterior of the body 18 is the stationary foot 22 (FIG. 2). The stationary foot 22 has a pair of claws 88 and is secured to a strike surface 90 by a bolt 92. The movable foot 20 is secured to the slide 38 by a bolt 94 or similar securement means. The movable foot 20 is provided with a single claw 96 which is preferably wider and positioned to fit between the pair of claws 88 on the stationary foot 22. The movable foot 20 is designed to fit into contiguous relationship with the stationary foot 22 when the slide is fully retracted (FIG. 1). The pair of claws 88 of the stationary foot 22 fit on either side of the single claw 96 of the movable foot 20, thereby creating a combined claw 98 being wider than, but having a profile no bigger than, the movable foot claw 96 alone (FIGS. 1 and 2).

The pumping apparatus 16 is secured to the body 18 of the tool 10 (FIG. 1). As described above, the knuckle 26 is pivotally connected to the pumping apparatus 16 by the pin 30 to allow the movable handle 12 to pivot in relationship to the pumping apparatus 16. Another pin 100 passes through the end of the knuckle 26 and a piston 102 so that as the knuckle 26 is pivoted by the movable handle 12, the piston 102 moves back and forth. The piston 102 has an eccentric hole 104 to prevent the pin 100 from binding as the knuckle 26 moves in its slightly arcuate path. The eccentricity of the hole 104 also allows enough play between the hole 104 and the pin 100 so that the piston 102 may move in a path parallel with the stationary handle 14, rather than along the arcuate path of the knuckle 26.

The pumping apparatus 16 is of the standard single action hydraulic type, and draws hydraulic fluid from a forward area 106 of the body 18, which is contiguous with the seal backing 72 (FIG. 1). The pumping apparatus 16 then forces the hydraulic fluid into a rearward area 108 of the body 18 which is contiguous with the seal 70. Positioned on the pumping apparatus 16 is a manually operated release valve 110. When a switch 112 mounted on the pumping apparatus 16 is pivoted, the valve 110 is opened and hydraulic fluid is allowed to flow from the rearward area 108 of the body 18 into the forward area 106 of the body 18. When the switch 112 is released, a spring mechanism (not shown) returns the switch 112 into the closed position. When the valve 110 is closed, the hydraulic fluid is prevented from flowing across the valve 110 between the rearward area 108 and the forward area 106. A particular advantage of transferring the hydraulic fluid through the interior of the pumping apparatus 16, rather than by exterior hoses, is the elimination of exposed loses which could be snagged or punctured by surrounding hazards during operation of the tool 10.

The tool is operated by placing the tool 10 between a pair of access blocking devices, such as between a door and a door jamb. In the case of a door, the tool 10 is forced between the door jamb and the door with the claws 88 and 96 of the feet 20 and 22 together. If there is not sufficient space to fit the tool 10 between the door jamb and the door, the strike surface 90 may be struck with a hammer or similar device to force the claws 88 and 96 between the door jamb and the door.

Once the claws 88 and 96 have been positioned between the door jamb and the door, the movable handle 12 is pivoted inward and outward in relationship to the stationary handle 14 (FIGS. 1 and 2). As the movable handle 12 is pivoted, hydraulic fluid is forced from the forward area 106 of the body 18 into the rearward area 108 of the body 18. As hydraulic fluid is forced into the rearward area 108 of the the body 18, the seal 70 and seal backing 72 are pushed toward the stationary foot 22, thereby moving the slide 38 outward and the movable foot 20 away from the stationary foot 22.

As the movable foot 20 moves away from the stationary foot 22 (FIG. 2), the door and the door jamb are pushed apart. The more the movable handle 12 is pumped, the further apart the feet 20 and 22 become, and the wider the opening is made between the door jamb and the door. The pumping continues until access can be gained through the opening generated between the movable foot 20 and the stationary foot 22. Typically, the movable foot 20 need only be moved a short distance from the stationary foot 22, before a lock securing the door shut is broken and access is gained through the door.

As the slide 38 extends, the key nut 48 contacts the spring 54 and compress the spring 54 until the slide 38 has been sufficiently extended (FIGS. 2 and 3). Once access has been gained, and the spring 54 compressed, the switch 112 is pivoted to open the release valve 110. The valve 110 allows the hydraulic fluid within the body 18 to pass from the rearward area 108 of the body 18 back into the forward area 106 of the body 18. Once the release valve 110 has been opened, the spring 54 begins to extend. As the spring 54 extends, it presses against the key nut 48 which, in turn, moves slide 38 rearward. As the slide 38 moves rearward, it causes the seal 70 connected to the slide to force hydraulic fluid from the rearward area 108 into the forward area 106 of the body 18. As the spring 54 becomes full extended, the feet 20 and 22 are brought back together. The switch 112 may thereafter be released so that the spring mechanism (not shown) acts to close the valve 110 and the tool 10 is again ready for use.

The key nut 48 and keyways 36 of the handle 14 of the present invention prevent the movable foot 20 from rotating in relationship to the stationary foot 22 as the tool 10 is being operated (FIG. 1). The keys **50*a–b* of the key nut 48 slide back and forth freely within the keyways 36 of the handle 14 so that the opening and closing of the tool 10 is not restricted (FIGS. 1 and 3). However, if forces act on the movable foot 20 to rotate the movable foot 20 in relationship to the stationary foot 22, an upper face 114 of one key 50*a* and a lower face 116 of the opposite key 50*b* press against the sides of the keyways 36 to brace the movable foot 20 against any such rotational movement (FIGS. 3, 4, and 8**).

FIGS. 9–10 show an alternative embodiment of the present invention wherein keys **118*a–b* of a key nut 120 are squared off and a separate sleeve 122 is provided with keyways 124. The sleeve 122 may be welded to the interior of the stationary handle or retained therein by set screws. This embodiment is similar to the preferred one-piece embodiment in its anti-rotation attributes and may also be used with the preferred rounded key nut 48**.

Figure 11:
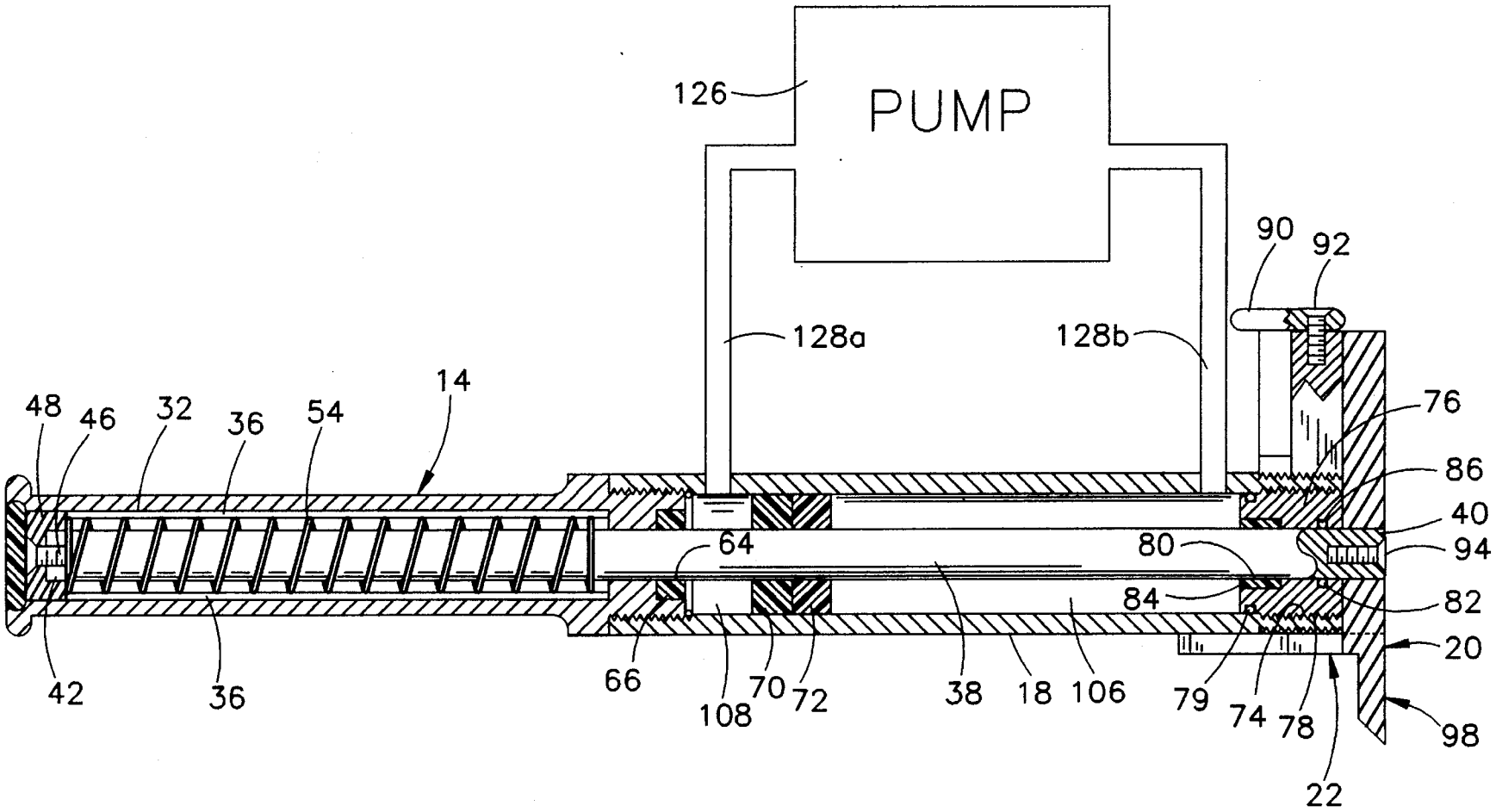
FIG. 11 is a side elevational view in partial cross-section showing a multipiece embodiment of the present invention.

The foregoing description and drawings merely explain and illustrate the invention. The invention is not limited thereto, except insofar as the claims are so limited, as those skilled in the art who have the disclosure before them will be able to make modifications and variations therein without departing from the scope of the invention. By way of example, it should be clear that the key nut may be provided with either one or a plurality of keys and that the stationary foot and movable foot may be provided with any number of claws. It should also be clear that the invention may be a multipiece unit with an external pump 126 connected to the body 18 of the tool 10 by a pair of fluid transfer hoses **128*a–b* (FIG. 11). All embodiments of the tool 10** may be employed in many ways to move objects away from one another.

What is claimed is:

1. An extensible one-piece forcible entry tool for gaining access to an area, having a first foot and a second foot, in which the fist foot is capable of being placed against a first access blocking article and the second foot is capable of being placed against a second access blocking article, and wherein the forcible entry tool has means for moving the first foot away from the second foot with sufficient force to move the first access blocking article away from the second access blocking article, the extensible forcible entry tool comprising:

a. a hollow, enclosed frame operably connected to the second foot, said frame having at least one keyway along an interior surface of and enclosed within said frame:

b. a slide operably connected to the first foot, said slide being operably coupled to said frame for slidable movement in relationship thereto;

c. a key operably positioned within said keyway capable of slidable movement in relationship thereto between a retracted position enclosed within said frame and an extended position enclosed within said frame;

d. means for moving said slide substantially coaxially in relationship to said frame; and e. wherein said key is operably connected to said slide to prevent rotational movement of said slide in relationship to said frame.

2. The extensible one-piece forcible entry tool of claim 1, wherein said means for moving said slide substantially coaxially in relationship to said frame is a hydraulic linear actuator comprising:

a. a moveable pump handle pivotally connected to said frame;

b. a hydraulic cylinder substantially surrounding said slide;

c. hydraulic fluid; and d. a hydraulic piston operably connected to said pump handle, so that as said pump handle is moved, said piston forces said hydraulic fluid into said cylinder, thereby moving said slide in relationship to said cylinder.

3. The extensible one-piece forcible entry tool of claim 1, further comprising means for drawing said slide into said frame, said means being operably connected between said slide and said frame.

4. The extensible one-piece forcible entry tool of claim 1, further comprising a strike surface operably connected to said frame which allows said tool to be struck and forced between the first access blocking article and the second access blocking article.

5. An extensible one-piece forcible entry tool for gaining access to an area, having a first foot and a second foot, in which the first foot is capable of being placed against a first access blocking article and the second foot is capable of being placed against a second access blocking article, and wherein the forcible entry tool has means for moving the first foot away from the second foot with sufficient force to move the first access blocking article away from the second access blocking article, the extensible forcible entry tool comprising:

a. a hollow, enclosed sleeve operably connected to the second foot;

b. a slide operably connected to the first foot, said slide being operably coupled substantially coaxially within said sleeve for slidable movement in relationship to said sleeve;

c. means for moving said slide substantially parallel and coaxially relative to said sleeve; and d. means enclosed within said sleeve for substantially restricting rotational movement of said slide in relationship to said sleeve.

6. The extensible one-piece forcible entry tool of claim 5, wherein said sleeve is provided on an interior surface with at least one keyway, and wherein said rotation restriction means is a key operably connected to said slide and operably positioned within said keyway in a manner which allows substantially parallel coaxial movement of said slide relative to said sleeve and which substantially restricts rotational movement of said slide relative to said sleeve.

7. An extensible one-piece forcible entry tool for gaining access to an area, the forcible entry tool having a first foot and a second foot, in which the first foot is capable of being placed against a first access blocking article and the second foot is capable of being placed against a second access blocking article, and wherein the forcible entry tool has means for moving the first foot away from the second foot with sufficient force to move the first access blocking article away from the second access blocking article, the extensible forcible entry tool comprising:

a. a hydraulic cylinder having a hydraulic fluid inlet and a hydraulic fluid outlet;

b. a slide positioned within said cylinder and operably coupled to said cylinder for parallel movement in relationship thereto;

c. a stationary handle connected to said cylinder, said handle being hollow and enclosed, and provided with at least one keyway along an interior surface of said stationary handle;

d. a flange operably connected to said slide, said flange being of a construction which substantially prevents the passage of hydraulic fluid through said cylinder around said flange;

e. key operably connected to said slide and operably positioned within said keyway being capable of allowing said slide to move parallel with respect to said stationary handle between a retracted position enclosed within said stationary handle and an extended position enclosed within said stationary handle, and further being capable of preventing said slide from rotating in relationship to said stationary handle;

f. a pump handle pivotally connected to said frame;

g. a hydraulic piston operably connected to said pump handle and being capable of forcing said hydraulic fluid through said hydraulic fluid inlet into said hydraulic cylinder to move said flange and said slide in relationship to said hydraulic cylinder; and h. means for forcing said hydraulic fluid from said hydraulic cylinder through said hydraulic fluid outlet.

* * * * *